US006817611B2

(12) United States Patent
DiRamio

(10) Patent No.: US 6,817,611 B2
(45) Date of Patent: Nov. 16, 2004

(54) NIP MECHANISM AND METHOD OF OPERATION THEREOF

(75) Inventor: Angelo DiRamio, Medford, MA (US)

(73) Assignee: Agfa Corporation, Wilmington, MA (US)

( * ) Notice: Subject to any disclaimer, the term of this patent is extended or adjusted under 35 U.S.C. 154(b) by 224 days.

(21) Appl. No.: 10/152,860

(22) Filed: May 22, 2002

(65) Prior Publication Data

US 2003/0217657 A1 Nov. 27, 2003

(51) Int. Cl.[7] ..... B65H 5/06
(52) U.S. Cl. ..... 271/273; 271/274
(58) Field of Search ..... 271/273, 274, 271/314, 902

(56) References Cited

U.S. PATENT DOCUMENTS

| | | | | | |
|---|---|---|---|---|---|
| 1,074,067 | A | * | 9/1913 | Rea | 271/273 |
| 2,411,503 | A | | 11/1946 | Amos et al. | 72/19.9 |
| 3,324,791 | A | | 6/1967 | Cassano et al. | 100/172 |
| 3,392,637 | A | * | 7/1968 | Back | 493/96 |
| 3,614,011 | A | | 10/1971 | Karr | |
| 3,659,838 | A | | 5/1972 | Dacis | 271/11 |
| 3,722,655 | A | | 3/1973 | Singer | 400/613.1 |
| 4,034,976 | A | * | 7/1977 | Lundblad | 271/10.09 |
| 4,155,545 | A | * | 5/1979 | Yanagawa et al. | 271/10.09 |
| 4,216,953 | A | * | 8/1980 | Varady et al. | 271/11 |
| 4,470,349 | A | * | 9/1984 | Godlewski | 101/233 |
| 4,581,618 | A | | 4/1986 | Watanabe et al. | 346/134 |
| 4,600,929 | A | | 7/1986 | Cardona et al. | |
| 4,627,607 | A | | 12/1986 | Ishii | 271/122 |
| 4,641,830 | A | | 2/1987 | Okuda et al. | 271/274 |
| 4,848,765 | A | * | 7/1989 | Torii | 271/274 |
| 4,861,018 | A | * | 8/1989 | Kerstein | 271/274 |
| 4,878,772 | A | | 11/1989 | Fukumoto et al. | 400/636.3 |
| 4,958,195 | A | * | 9/1990 | Firth et al. | 399/332 |
| 4,986,527 | A | * | 1/1991 | Ogoda | 271/250 |
| 5,030,025 | A | | 7/1991 | Mitcham et al. | |
| 5,119,727 | A | | 6/1992 | Miyamoto et al. | |
| 5,173,596 | A | * | 12/1992 | Kapinos et al. | 235/475 |
| 5,210,616 | A | * | 5/1993 | Kawasaki et al. | 358/296 |
| 5,496,024 | A | * | 3/1996 | Luethi et al. | 271/273 |
| 5,565,971 | A | | 10/1996 | Kuo et al. | |
| 6,173,952 | B1 | | 1/2001 | Richards et al. | 271/228 |

FOREIGN PATENT DOCUMENTS

| | | | | |
|---|---|---|---|---|
| JP | 60-188255 | * | 9/1985 | 271/273 |
| JP | 63-300045 | * | 12/1988 | 271/274 |
| JP | 2002-265084 | * | 9/2002 | 271/273 |
| JP | 2002-347294 | * | 12/2002 | 271/273 |

* cited by examiner

*Primary Examiner*—Donald P. Walsh
*Assistant Examiner*—Daniel K Schlak
(74) *Attorney, Agent, or Firm*—J. Grant Houston; Robert A. Sabourin

(57) ABSTRACT

A nip mechanism for a substrate transfer system includes: a first nip roller; a second nip roller located substantially vertically above the first nip roller; and a drive motor for driving the first nip roller and the second nip roller to feed a substrate between the first nip roller and the second nip roller when the drive motor is driven in a first direction. The second nip roller creates and maintains a nip with the first nip roller due to a force of gravity without using a spring or other mechanical device while the drive motor is driven in the first direction. The drive motor engages a one-way clutch for engaging a roller separation mechanism to raise and separate the second nip roller from the first nip roller when the drive motor is driven in a second direction. The first and second nip rollers maintain substantial vertical alignment with one another when the drive motor is driven in either direction.

5 Claims, 7 Drawing Sheets

NIP MECHANISM AND METHOD OF OPERATION THEREOF

BACKGROUND OF THE INVENTION

Nip mechanisms typically, minimally comprise upper and lower nip rollers. These nip rollers extend parallel to each other and directly oppose each other. They are used to move substrates. In one typical mode of operation, the nip rollers are initially separated from each other, i.e., open, and a substrate is inserted between the nip rollers. The nip rollers are then brought together, i.e., closed, to engage the substrate between the two nip rollers. One or both of the nip rollers are then driven to transfer the substrate.

One application for nip mechanisms is in platesetters. In this example, the substrates that the nip mechanisms manipulate are termed plates. Plates are typically large sheets that have been coated with photosensitive or thermally-sensitive material layers. The plates are usually used in commercial printing operations. For large run applications, the substrates are fabricated from aluminum, although organic substrates, such as polyester or paper, are also available for smaller runs. Computer-to-plate printing systems are used to render digitally stored print content onto these printing plates. Typically, a plate management system supplies individual plates to the platesetter. A computer system is used to drive an imaging engine of the platesetter. The engine selectively exposes the surfaces of these plates. After exposure, the plates are supplied to post exposure processing equipment.

The nip mechanisms are used in the transfer systems that move the plate substrates between the management system and the platesetter. After exposure in the platesetter, another transfer system is used to move the substrate to the post processing equipment.

Typically, the nip mechanisms are driven by electric motors. The motors can include encoders to monitor how far the substrates have been transferred. Further, especially in platesetter systems, the nip mechanisms are usually opened and closed using pneumatic cylinders that are operated by solenoids.

SUMMARY OF THE INVENTION

Pneumatic operation in these platesetter systems is very common. Typically, there are many tubes for the routing of the pressurized air throughout the system in order to provide necessary actuation force to the various components of the machine.

However, as these platesetter systems, for example, become more complex, offering higher levels of functionality, the routing of the pneumatic lines can become problematic. As a result, it is sometimes desirable to replace pneumatic with, for example, electrical or mechanical actuation, especially if such replacement will decrease the overall complexity of the system. Moreover, each pneumatically driven function requires a separate solenoid to control the airflow to an actuation mechanism, such as an air cylinder. These devices add incrementally to the overall cost of goods in the manufacture of these systems.

The present invention is directed concerns a nip mechanism for a substrate transfer system. It allows the nip mechanism to be actuated, such as opened and/or closed, by a motor, such as the drive motor for the nip mechanism. As a result, when using the present invention, the need to operate the nip mechanism pneumatically can be avoided. Essentially, the drive motor now performs a dual role, i.e., both driving the nip rollers and also opening and closing the nip mechanism. Thus, for a slightly more complex mechanical system, a pneumatic operation can be avoided.

In general, according to one aspect, the invention features a nip mechanism for a substrate transfer system. It comprises a first nip roller and a second nip roller. A drive motor is used to drive the first nip roller and a second nip roller to feed a substrate between the first nip roller and the second nip roller, when the drive motor is driven in a first direction. According to the present invention, the drive motor actuates, such as opens, the nip mechanism by separating the first nip roller from the second nip roller when the drive motor is driven in a second direction.

According to the present embodiment, the inventive nip mechanism comprises a roller separation mechanism and a one-way clutch for engaging the roller separation mechanism when the drive motor is driven in the second direction. In the present implementation, this roller separation mechanism comprises a cam that pushes the first nip roller and the second nip roller away from each other. A cam limiter can be used to prevent over-rotation of this cam.

According to the preferred embodiment, a floating bearing block is used on either side of the second nip roller. This allows the second nip roller to be urged out of engagement from the first nip roller. In the preferred embodiment, the second nip roller is an upper nip roller and the first nip roller is a lower nip roller. As a result, the second nip roller is biased toward the first nip roller by gravity.

A downstream drive roller is preferably used for conveying the substrate downstream of the first nip roller and the second nip roller.

A nip mechanism for a substrate transfer system includes: a first nip roller; a second nip roller located substantially vertically above the first nip roller, and a drive motor for driving the first nip roller and the second nip roller to feed a substrate between the first nip roller and the second nip roller when the drive motor is driven in a first direction. The second nip roller creates and maintains a nip with the first nip roller due to a force of gravity without using a spring or other mechanical device while the drive motor is driven in the first direction. The drive motor engages a one-way clutch for engaging a roller separation mechanism to raise and separate the second nip roller from the first nip roller when the drive motor is driven in a second direction. The first and second nip rollers maintain substantial vertical alignment with one another when the drive motor is driven in either direction.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

Figure 1:
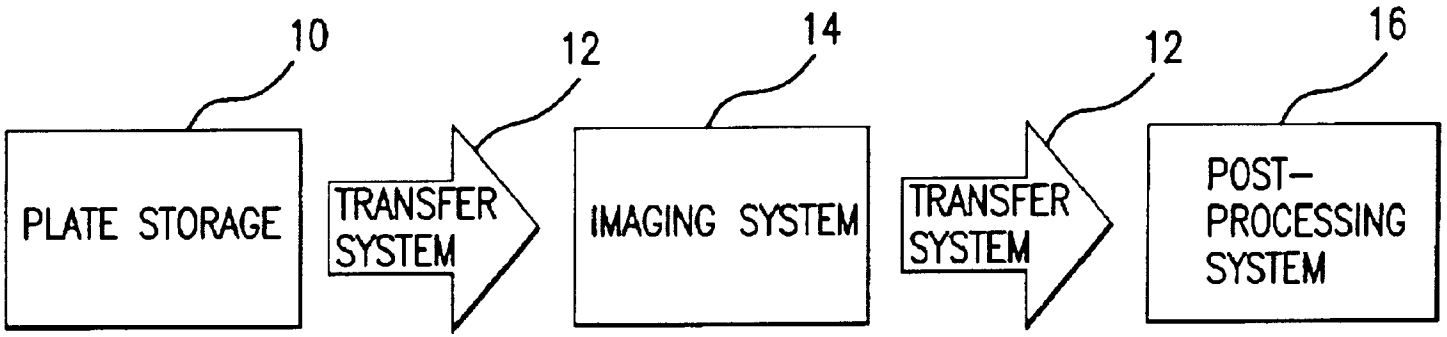
FIG. 1 is a block diagram illustrating the components of a platesetter system to which the present invention is applicable in one example.

FIG. 1 illustrates the overall components of a typical substrate processing system, such as a platesetter system, to which the present invention is applicable.

Specifically, substrates or plates are stored in plate storage 10. In the example of a platesetter, this storage can be a plate management system. A transfer system 12 is used to transfer individual substrates to an imaging system 14. In the example of a platesetter system, this imaging system can be an external drum platesetter. After the substrates have been exposed, another transfer system 12, or the previous transfer system in some configurations, moves the individual substrates to post processing systems 16 for development, for example, in the example of a platesetter system.

Figure 2:
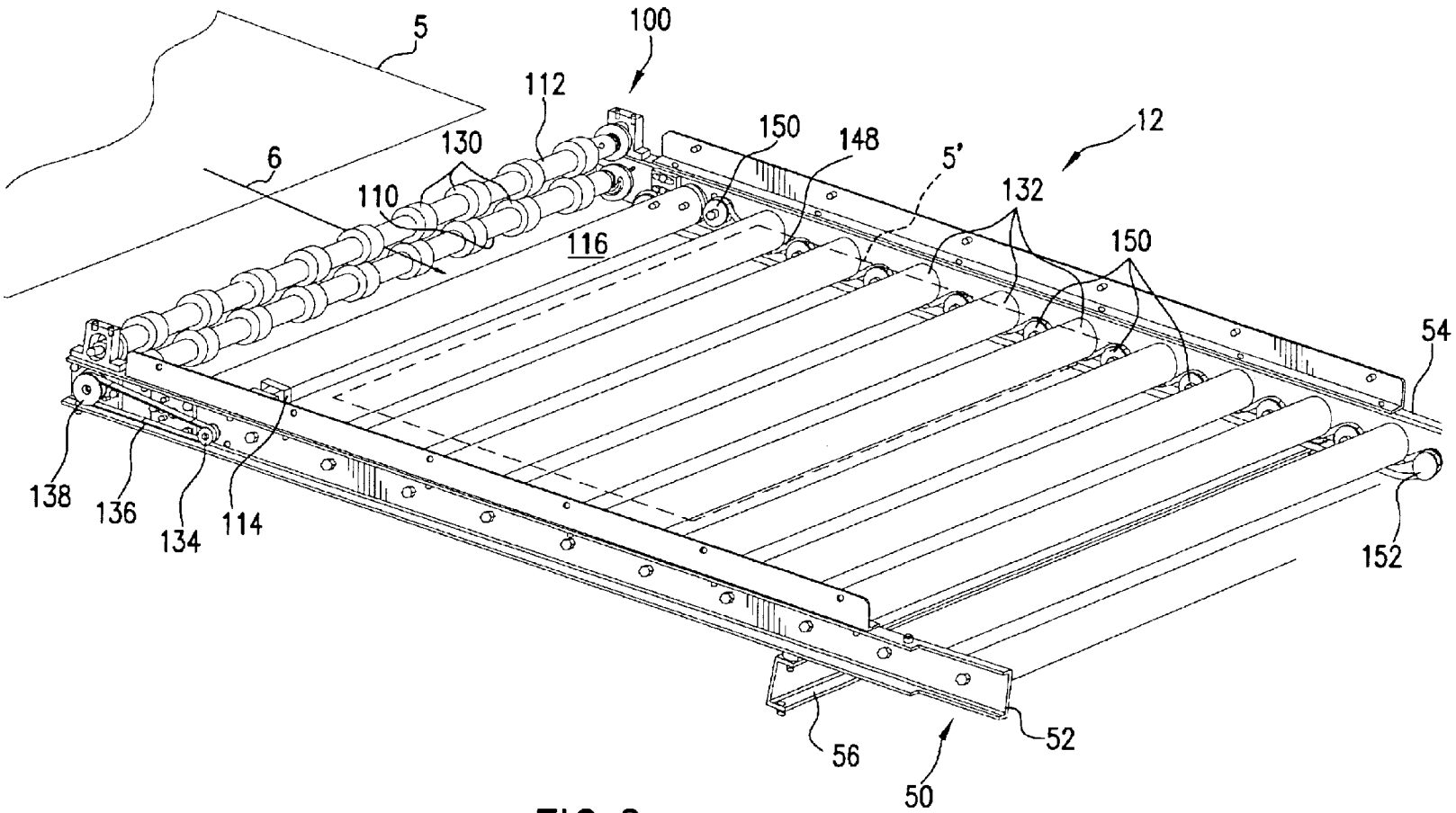
FIG. 2 is a perspective view of a substrate transfer system according to the present invention.

FIG. 2 shows a transfer system 12, which has been constructed according to the principles of the present invention. Specifically, substrate 5, such as a plate, is fed in the direction of arrow 6 to a nip mechanism 100. The nip mechanism 100 generally comprises a first, or lower, nip roller 110, and a second, or upper, nip roller 112.

Each nip roller 110, 112 has a series of friction drive wheels 130 distributed along their lengths. These drive wheels 130 are typically made of rubber or another high friction, yet soft material. As a result, the drive rollers 130 allow the nip rollers 110 and 112 to feed the substrate 5 in the direction of arrow 6, while not damaging that substrate, so that the substrate is advanced to position 5'.

The substrate 5' is supported and transferred on an array of travel rollers 132 that allow the substrate to be further moved to the next sub-system in the platesetter system, for example.

Structurally, the transfer system 12 comprises a transfer frame 50. The frame 50 comprises a right frame member 52 and a left frame member 54. A cross frame member 56 is bolted to the right frame member 52 and the left frame member 54 to extend between the right and left frame members to improve the overall rigidity to the frame 50.

The transfer system 12 is powered or actuated by a drive motor 114. It is bolted to the inside face of the right frame member 52 in the illustrated implementation. Its spindle extends through the right frame member 52. A drive motor pulley 134 is press-fit onto the motor's spindle and is located adjacent to the outer side of the right frame member 52. A drive motor belt 136 extends over the motor pulley 134 and a right roller pulley 138, which is press-fit onto the axle of the first nip roller 110. As a result, this motor belt 134 allows the drive motor 114 to rotate and thereby drive the first nip roller 110.

Figure 3:
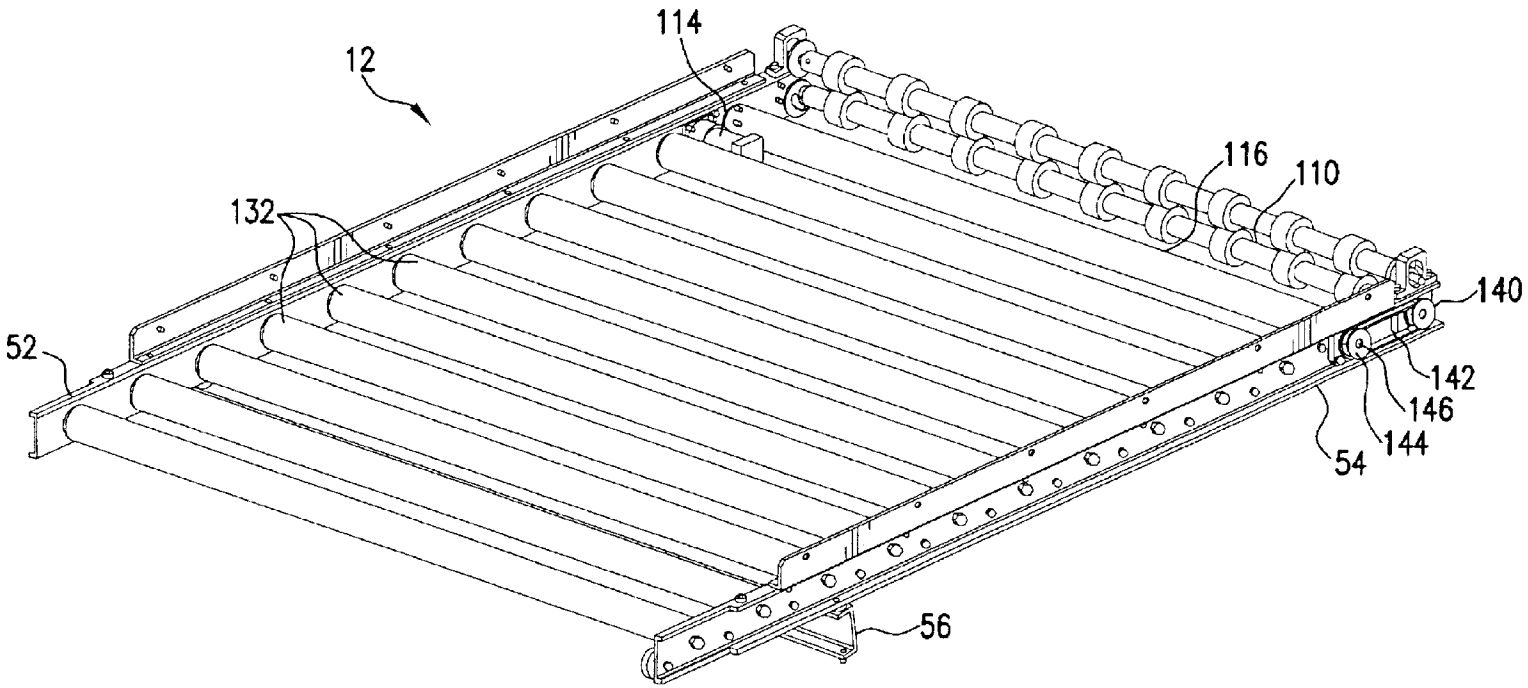
FIG. 3 is a reverse angle perspective view of the inventive substrate transfer system.

FIG. 3 shows the other end of the axle of the first nip roller 110. This axle extends through the left frame member 54 and terminates in a left roller pulley 140. A drive roller belt 142 extends over the left roller pulley 140 and a drive roller pulley 144. The drive roller pulley 144 is fit on the axle 146 of a drive roller 116.

With reference back to FIG. 2, the rotation of the drive roller 116 is used to operate or drive the travel rollers 132. Specifically, a transfer roller belt 148 wraps in a serpentine fashion over a series of tension pulleys 150 and the intervening travel rollers 132. In this way, the progress of the transfer roller belt 148, as driven by the drive roller 116, in turn drives all of the travel rollers 132 in tandem. A terminal tension pulley 152 returns the transfer roller belt 148 to form a complete circuit. Each one of the tension pulleys 150 is bolted and journaled to the inner wall to the left frame member 54. Each of the transfer rollers 132 is journaled to both the right and left frame members 52, 54.

Figure 4:
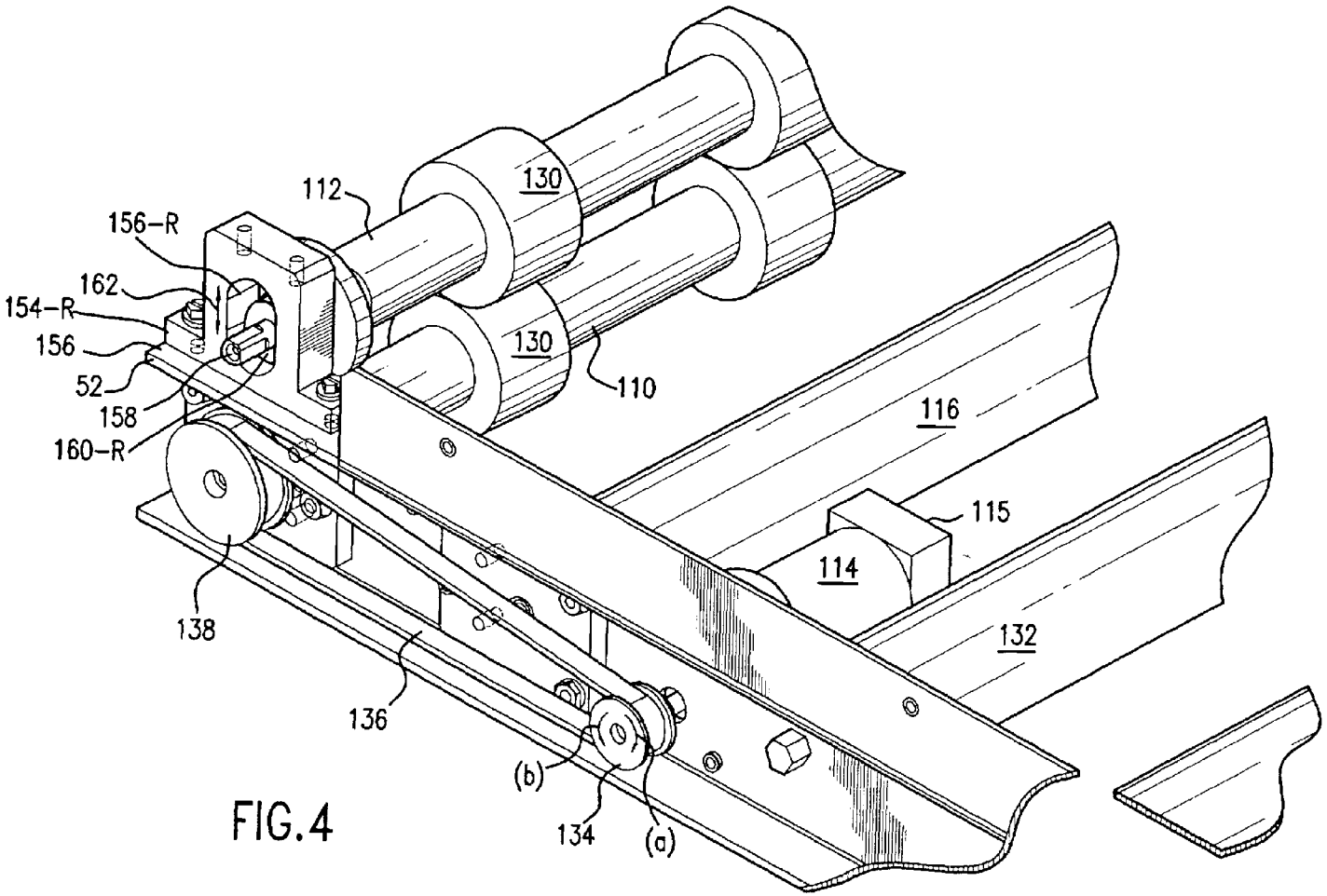
FIG. 4 is a close-up view showing the linkage between the drive motor and the first nip roller in the preferred embodiment of the present invention.

FIG. 4 shows the connection of the second nip roller 112 to the right frame member 52. Specifically, a bearing block 154-R is bolted to a top surface 156 of the right frame member 52. The right bearing block 154-R has an inner bore 156-R. An axle 158 of the second nip roller 112 extends into this bore 156-R. A bearing cartridge 160-R is housed within this inner bore 156-R. This allows the second nip roller 112 to freely rotate relative to the bearing block 154-R, yet translate up and down along the direction of arrow 162.

Figure 5:
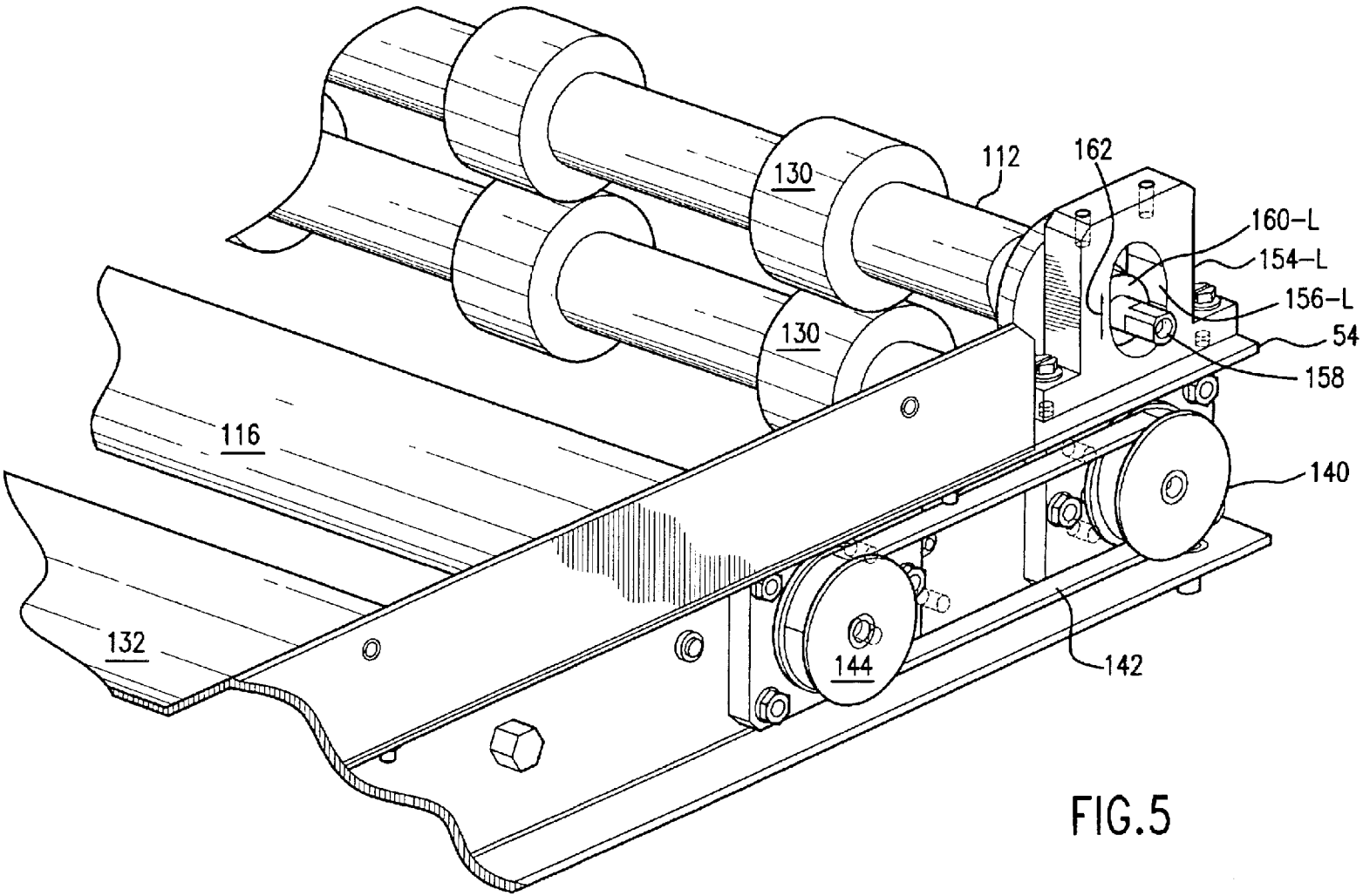
FIG. 5 is a close-up perspective view showing the linkage between the first nip roller and the drive roller according to the preferred embodiment of the present invention.

FIG. 5 shows a similar arrangement relative to the second nip roller 112 on its left end. Specifically, a left bearing block 154-L is bolted to the left frame member 54. The left bearing block 154-L has an inner bore 156-L. A left bearing cartridge 160-L of the second nip roller 112 extends into this inner bore 156-L to allow the second nip roller 112 to rotate relative to the left bearing block 154-L, yet move up and down in the direction of arrow 162.

Figure 6:
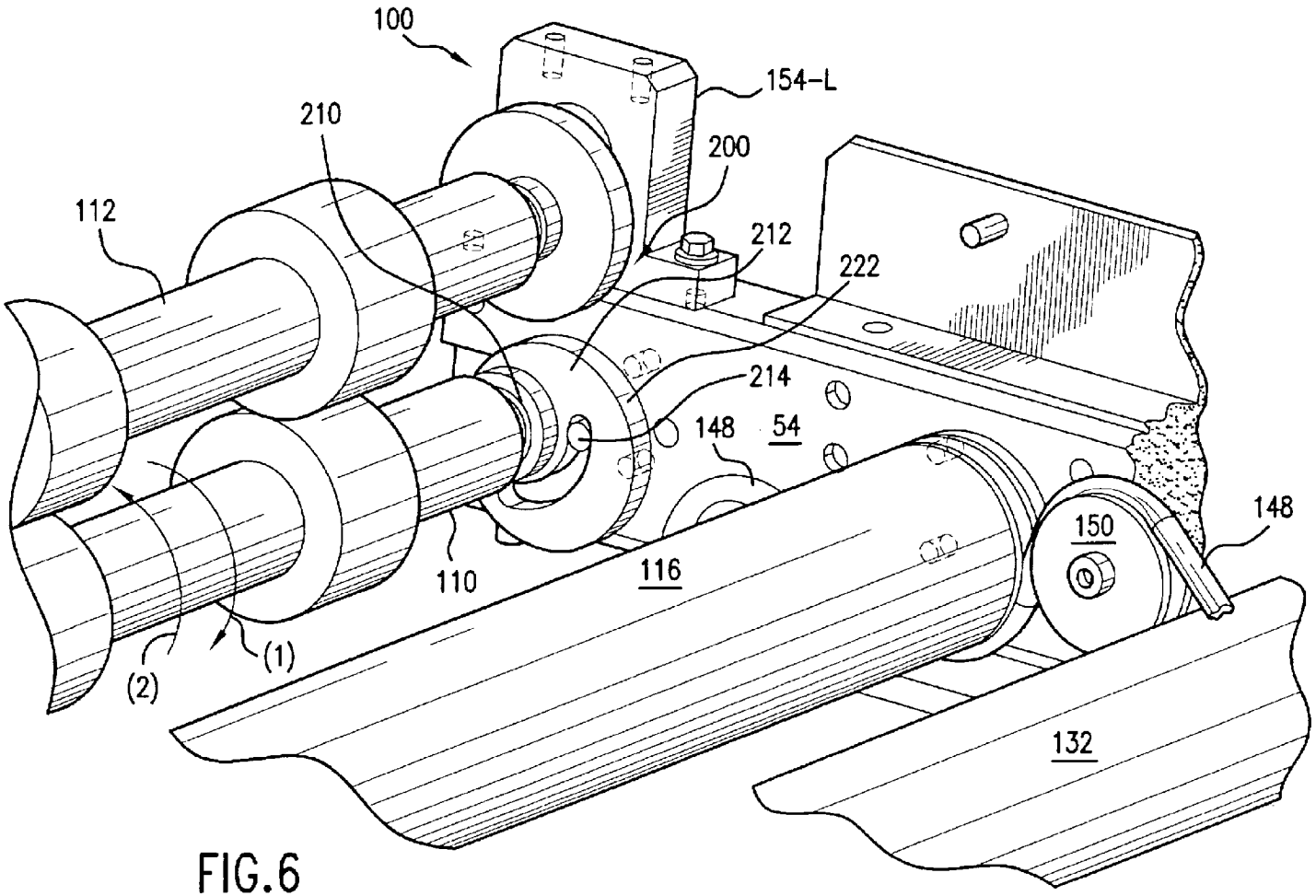
FIG. 6 is a close-up view showing the roller separation mechanism according to the present invention when the nip mechanism is closed.

FIG. 6 illustrates the roller separate mechanism 200 of the nip mechanism 100. Specifically, the nip roller 110 is rotated in the direction of arrow (1), when the drive motor 114 is rotated in the direction (a), see FIG. 4. A substrate between the first nip roller 110 and the second nip roller 112 will be fed to the drive roller 116. The first nip roller 110 is allowed to rotate in this direction by the slippage in a one-way roller clutch 210. This one-way clutch 210 allows the first nip roller 110 to rotate freely in the direction of arrow (1). With reference to FIG. 4, this corresponds with rotation in the direction of arrow (a) of the drive motor 114.

Figure 7:
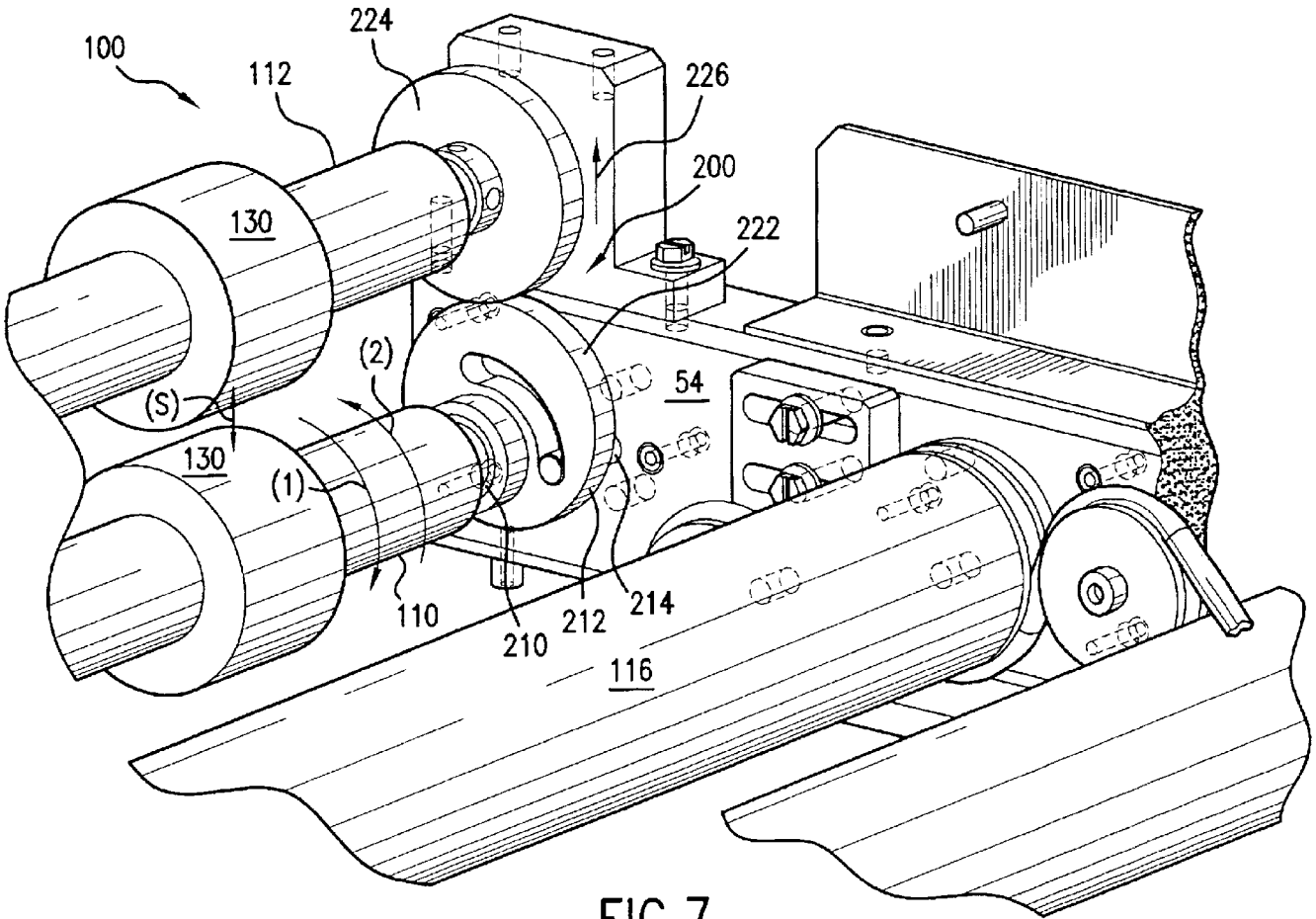
FIG. 7 is a close-up perspective view of the roller separation mechanism when the nip mechanism is in an open position according to the present invention.

FIG. 7 illustrates the opening of the nip mechanism 100 by the roller separation mechanism 200. Specifically, when the first nip roller 110 is rotated in the direction of arrow (2) by the drive motor 114 rotating in the direction of arrow (b), the one-way roller clutch 210 converts to a locked state. As a result, the rotation of the nip roller 110 in the direction of arrow (2) causes a cam 212 to rotate with the first nip roller 110. The outer cam surface 222 of the cam 212 comes into engagement with a nip wheel 224 that is rigidly secured to and co-axial with second nip roller 112. As the cam 212 is fully rotated, it urges the second nip roller 112 upwards in the direction of arrow 226, thereby opening a space S between the first nip roller 110 and the second nip roller 112 and specifically, the drive wheels 130 of each nip roller 110, 112.

According to the preferred embodiment, the motor 114 comprises an encoder 115 that allows for software control of the angular movement of the motor 114. Specifically, during the opening of the nip mechanism 100, the motor 114 is driven through the angular rotation required to rotate the cam 212 approximately 90 to 120 degrees to thereby open the nip mechanism 100.

The action of the cam 212 pushing on the nip wheel 224 to separate the first nip roller 110 from the second nip roller 112 has the result of the opening the nip mechanism 100 so that it can receive the substrate 5.

When the cam 212 has been sufficiently rotated, the drive motor 114 remains energized to hold its position. In a current implementation, if it were de-energized and the roller 110 allowed to freewheel, the force of gravity on the second nip roller 112 would cause the cam 212 to rotate back.

In typical operation, the substrate 5 is inserted between the first nip roller 110 and the second nip roller 112. Its position is detected by a detector system that detects the leading edge of the substrate after it has been fully inserted into the nip mechanism 100 between the first and the second nip rollers 110, 112.

The drive motor 114 is then reversed from rotating in the direction of arrow (b) to the direction of arrow (a) to thereby rotate the cam 212 in the direction of arrow (1), thereby rotating the cam 212 to allow the second nip roller 112 to close down onto the first nip roller 110, and with further rotation, advance the substrate 5 to the drive roller 116 and the travel rollers 132.

According to the preferred embodiment, a cam limiter pin 214 is provided that projects from the left frame member 54 into an arcuate bore 230 formed in the cam 212. This cam limiter pin 214 prevents over-rotation of the cam 212 when the first nip roller 110 is driven in the direction of (2) to open the nip mechanism 110 and also prevents over-rotation of the cam 212 when the first nip roller 110 is advanced in the direction of (1) to initially close the nip mechanism 100, and then restricts the further progress of the cam 212, so that the cam 212 is in a known angular position during a subsequent nip opening operation.

While this invention has been particularly shown and described with references to preferred embodiments thereof, it will be understood by those skilled in the art that various changes in form and details may be made therein without departing from the scope of the invention encompassed by the appended claims. For example, a separate motor is used in some implementations to operate the cam. In this implementation, a motor system is provided that comprises a drive motor for driving the first nip roller and the second nip roller to feed the substrate and a separate roller separation motor for operating the roller separation mechanism.

What is claimed is:

1. A nip mechanism for a substrate transfer system, comprising:

a first nip roller;

a second nip roller located substantially vertically above the first nip roller; and a drive motor for driving the first nip roller and the second nip roller to feed a substrate between the first nip roller and the second nip roller when the drive motor is driven in a first direction, the second nip roller creating and maintaining a nip with the first nip roller due to a force of gravity without using a spring while the drive motor is driven in the first direction, and the drive motor engaging a one-way clutch for engaging a roller separation mechanism to raise and separate the second nip roller from the first nip roller when the drive motor is driven in a second direction, the first and second nip rollers maintaining substantial vertical alignment with one another when the drive motor is driven in either direction.

2. A nip mechanism as claimed in claim 1, wherein the roller separation mechanism comprises a cam that pushes the first nip roller and the second nip roller away from each other.

3. A nip mechanism as claimed in claim 1, further comprising a cam limiter for preventing over-rotation of the cam.

4. A nip mechanism as claimed in claim 1, further comprising floating bearing blocks on either end of the second nip roller allowing the second nip roller to translate away from the first nip roller.

5. A nip mechanism as claimed in claim 1, further comprising a drive roller downstream of the first nip roller and the second nip roller for conveying the substrate.

* * * * *